US006268040B1

(12) United States Patent
McArthur

(10) Patent No.: US 6,268,040 B1
(45) Date of Patent: Jul. 31, 2001

(54) SANITARY INSERT

(76) Inventor: Erich McArthur, 606 Fox Run, Winder, GA (US) 30680

( * ) Notice: Subject to any disclaimer, the term of this patent is extended or adjusted under 35 U.S.C. 154(b) by 0 days.

(21) Appl. No.: 09/287,648

(22) Filed: Apr. 7, 1999

(51) Int. Cl.[7] ..... B32B 3/24

(52) U.S. Cl. ..... 428/132; 428/131; 428/192; 428/119; 428/156; 428/174; 206/362; 206/362.1; 211/65; 248/110; D6/528; D6/534; 220/782; 220/709; 220/736; 220/713

(58) Field of Search ..... 428/131, 132, 428/192, 119, 156, 174; 206/362; 211/65; 248/110; D6/528, 534; 220/782, 709, 736, 713

(56) References Cited

U.S. PATENT DOCUMENTS

| | | | | |
|---|---|---|---|---|
| D. 228,271 | * | 9/1973 | Tecner | D6/92 |
| D. 283,961 | | 5/1986 | Doyle | D6/534 |
| D. 294,093 | | 2/1988 | Tegner | D6/531 |
| D. 309,840 | | 8/1990 | Estvold | D6/534 |
| D. 341,510 | | 11/1993 | Lieberman | D6/528 |
| 1,465,627 | * | 8/1923 | Fisher et al. | 206/362 |
| 1,972,532 | * | 9/1934 | McMillan | D6/534 |
| 2,956,851 | * | 10/1960 | Merendino | 206/362 |
| 3,048,317 | * | 8/1962 | Cochrane | 220/782 |
| 5,301,799 | * | 4/1994 | Gurba, Jr. | 206/1.7 |
| 5,690,214 | * | 11/1997 | Gaines et al. | 206/209.1 |

* cited by examiner

*Primary Examiner*—William P. Watkins, III
(74) *Attorney, Agent, or Firm*—Rodgers & Rodgers

(57) ABSTRACT

A sanitary insert comprising a base panel, multiple apertures formed in the base panel, a sanitary band extending around the periphery of each aperture and downwardly therefrom, and a locking band integrally joined to the base panel.

10 Claims, 4 Drawing Sheets

SANITARY INSERT

BACKGROUND OF THE INVENTION

In hotels, hospitals and other similar types of facilities intended for overnight or extended stays, local laws and ordinances typically prohibit permanent fixtures intended for storage of personal care items. For example, common bathroom wall mounted combination toothbrush and tumbler or glass holders are not allowed in public accommodation facilities because of the unsanitary nature of these holders due to bacterial buildup. As a result, a patron of a hotel, motel or other like establishment must place his or her personal care items on the sink top, in a drawer and the like wherein such items are disorganized and are more likely to become contaminated or discarded.

SUMMARY OF THE INVENTION

A sanitary insert for use in combination with a conventional wall mounted or free standing toothbrush holder comprising a base panel, multiple apertures formed in the base panel, a sanitary band integrally joined to the base panel around the periphery of each aperture and extending downwardly therefrom, and locking means joined to the base panel and extending downwardly or upwardly therefrom.

DESCRIPTION OF THE PREFERRED EMBODIMENT

Figure 1:
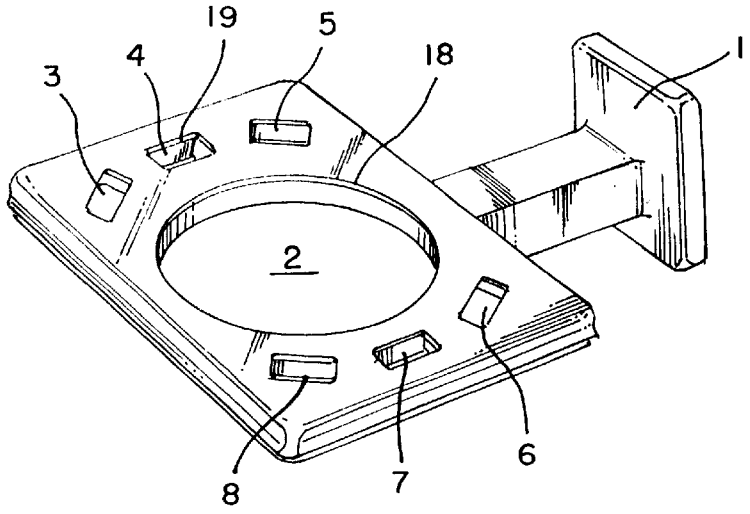
FIG. 1 is a perspective view of a wall mounted toothbrush and tumbler holder in combination with a sanitary insert according to this invention.
Figure 2:
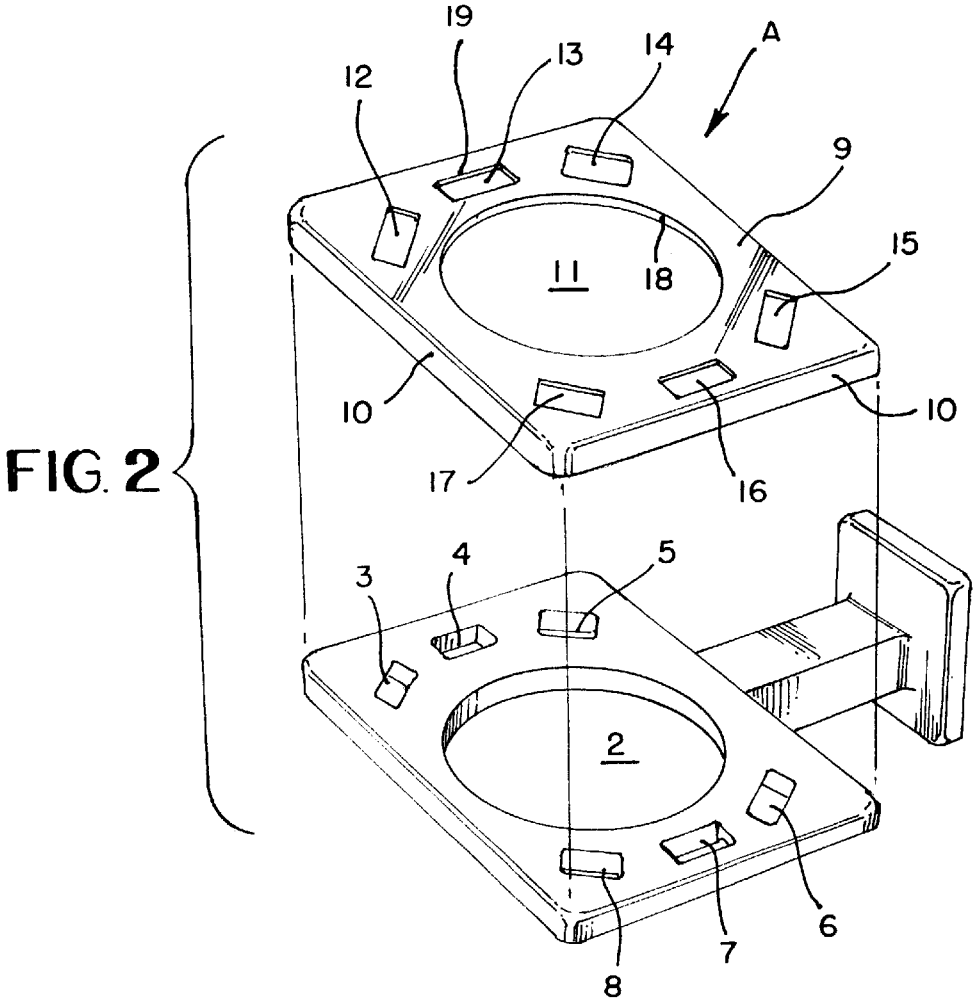
FIG. 2 is an exploded view of the holder and insert shown in FIG. 1.

In the drawings, and with particular reference to FIGS. 1 and 2, the numeral 1 designates a conventional wall mounted toothbrush and tumbler holder. More specifically, holder 1 includes aperture 2 for receiving a tumbler or glass and also includes multiple generally rectangular apertures 3–8.

According to one form of this invention, a sanitary insert is provided and is generally indicated by the letter A.

More specifically, insert A includes base panel 9 with side panels 10 integrally joined to each outer edge of base panel 9 and extending downwardly therefrom. In addition, center aperture 11 and multiple generally rectangular apertures 12–17 are formed in base panel 9. Aperture 11 includes wall 18 which is integrally joined to base panel 9 around the periphery of aperture 11 and extends downwardly therefrom, of course, aperture 11 can be omitted, if desired.

Each of t he apertures 12–17 is of identical construction and includes side walls 19 integrally joined respectfully to base panel 9 at the peripheral edges of apertures 12–17 and extending downwardly therefrom. Each end of side walls 19 is integrally joined to the adjacent end of each associated side wall 19 to form a continuous sanitary band which overlaps the associated edges of holder 1 and extends into the respective apertures 3–8, as shown in FIG. 1.

Figure 3:
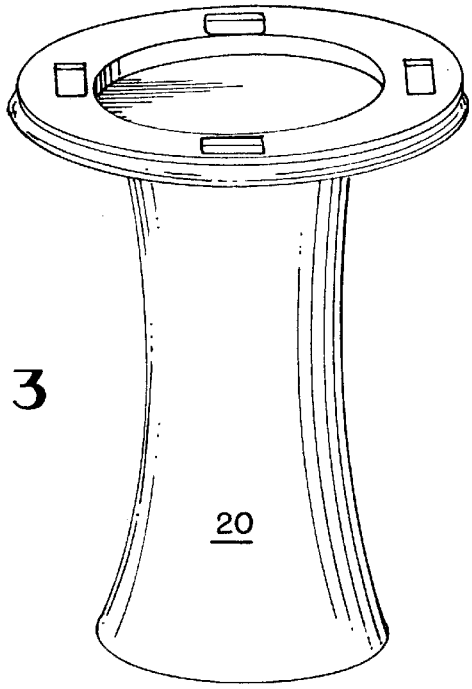
FIG. 3 is a pedestal-type holder in combination with a sanitary insert according to this invention.
Figure 4:
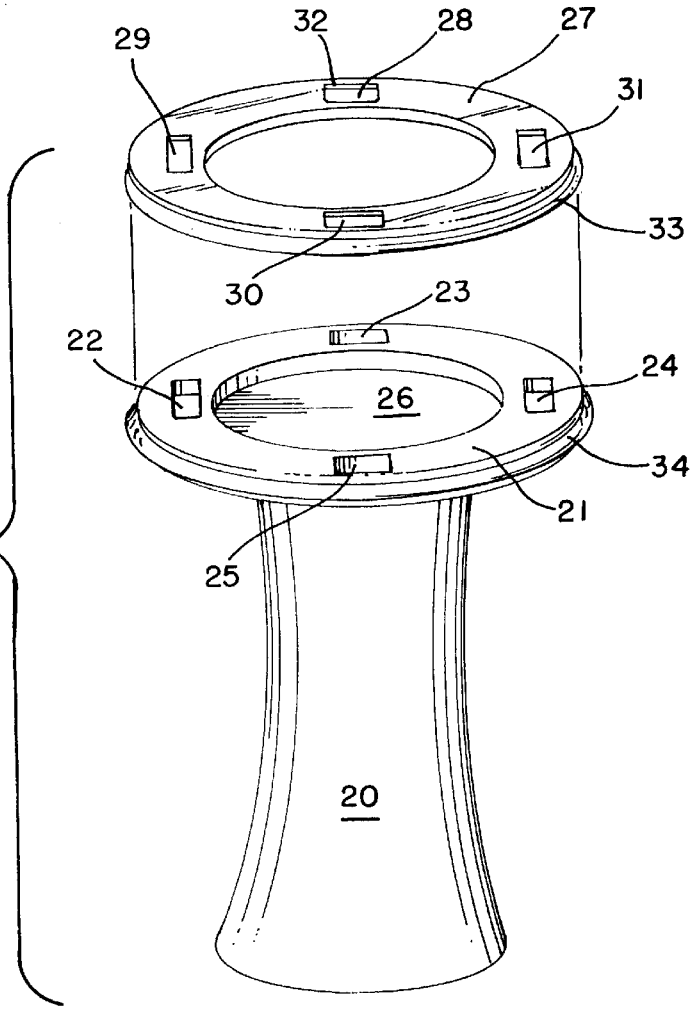
FIG. 4 is an exploded view of the holder shown in FIG. 3.

In FIGS. 3 and 4, a modified form of the invention is shown for use in connection with a free standing pedestal-type holder 20. Pedestal 20 includes top 21 having toothbrush receiving apertures 22, 23, 24 and 25 formed therein together with circular glass-receiving indention 26.

The sanitary insert shown in FIGS. 3 and 4 includes circular base panel 27 with rectangular apertures 28, 29, 30 and 31 formed therein. Each of the apertures 28–31 includes sanitary band 32 extending downwardly from the panel 27 around the peripheral edges thereof as previously described in connection with side walls 19 of the insert shown in FIGS. 1 and 2.

In addition, the insert shown in FIGS. 3 and 4 is provided with a generally concave locking band 33 and which is integrally joined to the outer peripheral edge of circular base panel 27 and extends downwardly therefrom such that when the insert is placed on top 21 of pedestal 20, it is in effect locked in position whereby locking band 33 is snapped into an overlapping and interlocking relationship with outer lip 34 formed around the periphery of top 21.

Figure 5:
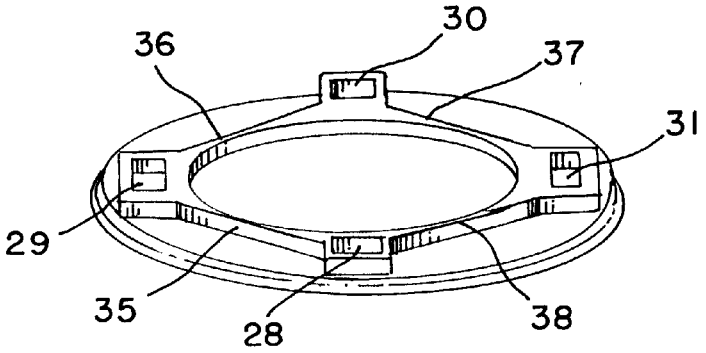
FIG. 5 is a perspective view of the upper side of one form of the insert shown in FIGS. 3 and 4.
Figure 6:
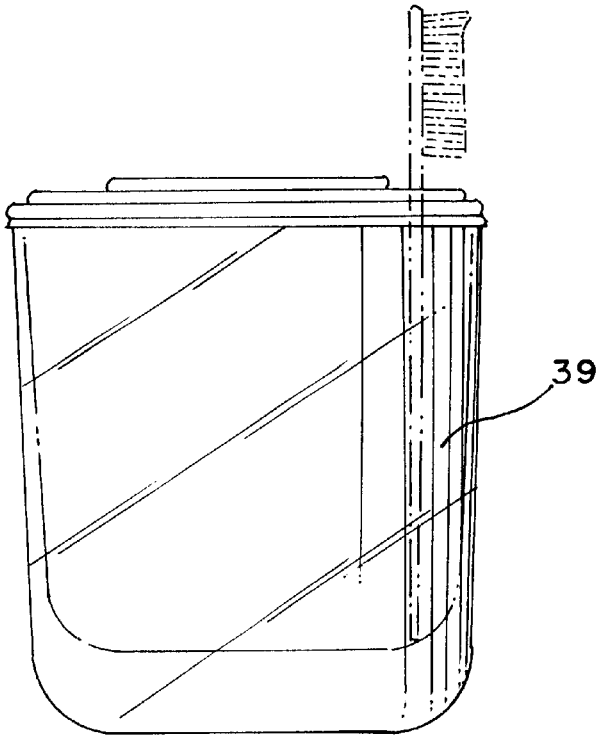
FIG. 6 is a side elevational view of a tumbler with an insert attached thereto.

In FIG. 5, the upper side of the insert, shown in FIGS. 3 and 4, includes the additional feature of strengthening ribs 35, 36, 37 and 38 which interconnect adjacent ones of apertures 28, 29, 30 and 31.

Figure 7:
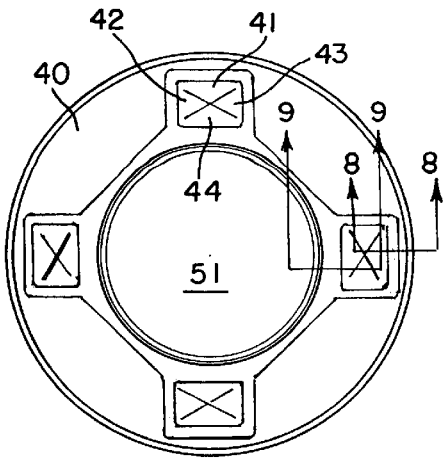
FIG. 7 is a top plan view of the insert shown in FIG. 6.
Figure 8:
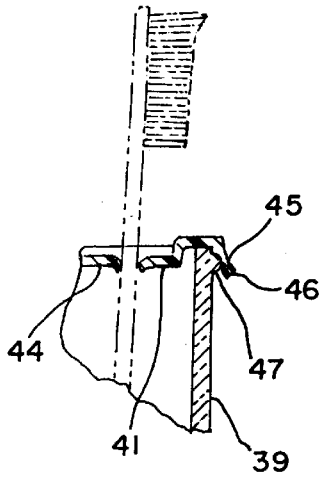
FIG. 8 is a cross-sectional view taken along the line 8—8 in FIG. 7.

FIGS. 6–9 show a further alternative form of the invention wherein a conventional glass or tumbler 39 or pedestal 20 is utilized as the holder or stand for sanitary insert 40. The construction of insert 40 is similar to that shown and described in connection with the insert shown in FIGS. 3, 4 and 5 with the additional feature of tabs 41, 42, 43 and 44 formed in each aperture and being integrally joined to insert 40 at the associated edge of each aperture. Therefore, when a toothbrush is inserted into an aperture, as shown in FIG. 8, it is held in place by the biasing action of the inner ends of tabs 41–44 against the toothbrush.

Further, insert 40, in one form, is held in position by means of locking band 45 which is joined to the outer periphery of insert 40 and extends downwardly therefrom in an overlapping relationship with the top edge of glass 39 as best shown in FIG. 8. Locking band 45 is provided with a contiguous flared edge 46 as a convenient means to grasp and remove the insert from glass 39 and additional locking capability is provided in the form of multiple dimples 47 formed around band 45.

Figure 10:
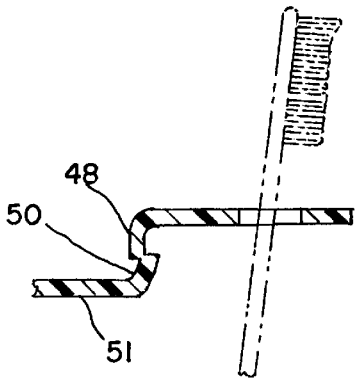
FIG. 10 is a cross-sectional view taken along the line 10—10 in FIG. 11.

In FIG. 10, a locking mechanism for use in combination with a holder having an indentation, such as indentation 26 shown in FIG. 4 is provided in the form of locking band 48 which is integrally joined to the inner edge of ring 49 and extends downwardly therefrom. Band 48 is adapted to overlap the outer edge of indentation 26.

Figure 11:
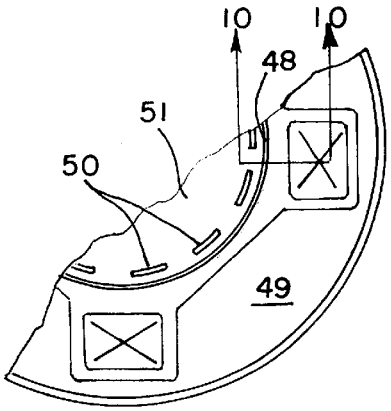
FIG. 11 is a partial view of a modified form of the insert shown in FIG. 7.

A further modified form of the invention is shown in FIG. 11 wherein a plurality of offsets 50 are formed around band 48. By this means, the sanitary insert is held in place by the interlocking relationship, for instance, in connection with indentation 26, the edge of which is slightly bowed and the upper edge of offset 50.

Also, shown in FIGS. 7 and 10, is inner panel 51 which is integrally joined to insert 40 and provides a means for printing advertising and other like material thereon.

Figure 9:
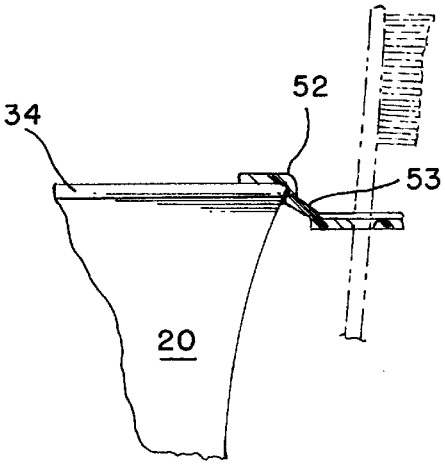
FIG. 9 is a cross-sectional view taken along the line 9—9 in FIG. 71

In FIG. 9, the insert is held in position by means of upwardly extending locking means which comprises continuous band 52 and multiple scalloped tabs 53 disposed therebelow. As shown in FIG. 9, the upper surfaces of tabs 53 engage the lower edge of lip 34 in a locking relationship.

Therefore, by this invention, a sanitary insert is provided wherein conventional wall mounted toothbrush and tumbler holders, pedestal-type holders and the like are protected from bacterial accumulation. The sanitary inserts are inexpensive and generally manufactured of paper or plastic and are quickly and easily placed on conventional holders for single customer usage and then simply discarded and replaced.

What is claimed is:

1. A flexible and disposable sanitary cover comprising a base panel, at least a pair of apertures formed in said base panel, a sanitary band integrally joined to said base panel around the periphery of each of said apertures and extending downwardly therefrom, and a strengthening rib formed in said base panel and extending between said pair of apertures.

2. A sanitary cover according to claim 1 wherein a locking band is integrally joined to the outer peripheral edge of said base panel and extends downwardly therefrom.

3. A sanitary cover according to claim 2 wherein said locking band is of a concave configuration.

4. A sanitary cover according to claim 2 wherein multiple dimples are formed on said locking band.

5. A sanitary cover according to claim 1 wherein an inner edge is formed in said base panel.

6. A sanitary cover according to claim 5 wherein a sanitary band is integrally joined to said base panel around said inner edge and extends downwardly therefrom.

7. A sanitary cover according to claim 5 wherein multiple offsets are formed around said inner edge.

8. A sanitary cover according to claim 5 wherein a locking band is integrally joined to said base panel around said inner edge and extends upwardly therefrom.

9. A sanitary cover according to claim 5 wherein said inner edge is circular.

10. A sanitary cover according to claim 5 wherein a locking band is integrally joined to said base panel around said inner edge and extends downwardly therefrom.

* * * * *